US005175525A

United States Patent [19]

Smith

[11] Patent Number: 5,175,525

[45] Date of Patent: Dec. 29, 1992

[54] LOW PROFILE TRANSFORMER

[75] Inventor: David A. Smith, Kowloon, Hong Kong

[73] Assignee: Astec International, Ltd., Hong Kong

[21] Appl. No.: 705,337

[22] Filed: Jun. 11, 1991

[51] Int. Cl.[5] ..... H01F 15/02; H01F 27/30

[52] U.S. Cl. ..... 336/83; 336/96; 336/183; 336/223; 336/232

[58] Field of Search ..... 336/83, 183, 180, 181, 336/223, 232, 96, 200

[56] References Cited

U.S. PATENT DOCUMENTS

| | | | |
|---|---|---|---|
| 1,224,184 | 5/1917 | McConahey | 336/183 |
| 2,535,554 | 12/1950 | Thurston | 336/183 |
| 2,882,504 | 4/1959 | Hultgron | 336/96 |
| 3,271,716 | 9/1966 | Furtn | 336/181 |
| 3,451,021 | 6/1969 | Atherton | 336/96 |
| 3,559,134 | 1/1971 | Daley | 336/96 |
| 3,848,208 | 11/1974 | Dawson et al. | 336/96 |
| 4,577,175 | 3/1986 | Burgher et al. | 336/183 |
| 4,584,551 | 4/1986 | Burgher et al. | 336/96 |
| 4,959,630 | 9/1990 | Yerman et al. | 336/183 |
| 5,010,314 | 4/1991 | Estrov | 336/232 |
| 5,017,902 | 5/1991 | Yerman et al. | 336/83 |

FOREIGN PATENT DOCUMENTS 29274 of 1915 United Kingdom ..... 336/223

OTHER PUBLICATIONS

Alex Estrov, "1-MHz Resonant Converter Power Transformer is Small, Efficient, Economical", Aug. 1986, PCIM Magazine, p. 14, et seq.

*Primary Examiner*—Thomas J. Kozma

*Attorney, Agent, or Firm*—McCubbrey, Bartels, Meyer & Ward

[57] ABSTRACT

The present invention provides a power transformer having a low profile and low overall volume. The power transformer also has improved isolation between the primary and the secondary windings, while at the same time providing improved electromagnetic coupling between these windings. The power transformer comprises an insulating enclosure for encapsulating a primary winding wound therein. The secondary winding comprises two electrically connected planar windings stamped from a conductive foil sheet. The insulating enclosure is positioned between the two planar windings of the secondary winding. The power transformer also comprises a core for coupling magnetic flux from the primary winding to the secondary winding.

13 Claims, 4 Drawing Sheets

LOW PROFILE TRANSFORMER

FIELD OF THE INVENTION

This invention relates to power transformers, and more particularly to an improved power transformer having a low profile, increased electromagnetic coupling between the primary and the secondary winding, and better isolation characteristics.

BACKGROUND OF THE INVENTION

It has been found that the use of distributed power supplies, i.e., placing a plurality of power converters close to the loads in an electronic system instead of using one centralized power supply, improves the performance of the electronic system. There are several reasons for this improved performance. One of the reasons is that the transient response to a sudden change in load degrades as the distance between the power converter and the load increases. The degradation is introduced by the resistive and inductive effects inherent in the conducting cable connecting the power converter and the load. If the power converter is placed close to the load, the length of the cable decreases thereby improving the transient response. Another reason is that each power converter in the distributed power supply system could be designed to match the requirements of its corresponding load while the design of a centralized power supply necessarily introduces compromises.

One of the requirements for placing a power converter close to a load is that the power converter must have a dimension smaller than the available space surrounding the load. Many modern electronic systems place cards populated with electronic elements in slots close to each other. Thus, the power converter should have a low profile because its height preferably should be smaller than the distance between the cards.

The power transformer is one of the largest components in a power converter. Many components used in a power converter have physically shrunk due to the improvements in materials, availability of specialized integrated circuits, surface mount packaging that enables the surface mounting of components on printed circuit boards, and improvements in circuit design. Likewise, the physical size of a power transformer has shrunk due to the increased switching frequency, typically around 1 MHz, and the availability of more efficient ferrite core materials. However, it is still desirable to reduce the physical size of a power transformer further.

There are problems associated with switching a power transformer at a high frequency and reducing the size of the power transformer. A higher switching frequency increases conduction loss in the transformer's windings because the conduction loss due to skin effect and proximity effect increases with frequency. A higher rate of change in operation flux also increases both the hysteresis loss as well as eddy current loss in the core. These losses are transformed into thermal energy. The ability to dissipate thermal energy is proportional to the surface area of the power transformer. As the physical dimension of the transformer is reduced, the ability to dissipate thermal energy decreases, thereby increasing the risk that the temperature of the power transformer will rise above the transformer's maximum allowable operating temperature.

Another problem with reducing the size of a power transformer is that there may not be sufficient space in the transformer for accommodating insulating material. As a result, the isolation between the primary and the secondary windings is reduced. The safety requirements for a transformer connected to an AC line are governed by UL 1950 and IEC 950. Both regulations required that the creepage distance, i.e., the shortest distance between two conducting parts of the primary and the secondary winding measured along the surface of the insulating material between them, be at least 5 mm. In addition, the insulation between the primary and the secondary windings must have a minimum thickness of 0.4 mm and be able to withstand a Hi-Pot test of 3000 VAC. As the size of a power transformer is reduced, it becomes more difficult to satisfy these safety requirements.

A further problem associated with reducing the size of a power transformer is that the electromagnetic coupling between the primary and the secondary windings may be reduced. The electromagnetic coupling between these two windings is related to the amount of magnetic flux generated by the primary winding which reaches the secondary winding. The size and shape of the primary and the secondary windings may not be optimal for electromagnetic coupling due to the reduction in size of the power transformer.

SUMMARY OF THE INVENTION

Broadly stated, the present invention is a power transformer comprising an insulated primary winding having its winding wire encapsulated in an insulating enclosure. The primary winding has a first and a second planar surface which are substantially parallel to each other. The primary winding generates magnetic flux in response to a current. The power transformer also comprises a secondary winding having a first and a second conductive planar winding. The first and second planar windings are electrically connected. The primary winding is positioned between the first and the second planar windings such that the first planar surface faces the first planar windings and the second planar surface faces the second planar winding. The power transformer further comprises means for coupling the magnetic flux from the primary winding to the secondary winding thereby allowing energy to transfer from the primary winding to the secondary winding.

Therefore, it is an object of the present invention to provide an improved power transformer.

It is another object of the present invention to provide a power transformer having low profile and low overall volume.

It is a further object of the present invention to provide a power transformer having improved isolation between the primary and the secondary windings.

It is still another object of the present invention to reduce losses in a power transformer.

It is yet another object of the present invention to improve the electromagnetic coupling between the primary and the secondary windings.

These and other objects and advantages of the present invention will become apparent from the following description and accompanying drawings.

DETAILED DESCRIPTION OF THE INVENTION

Figure 1:
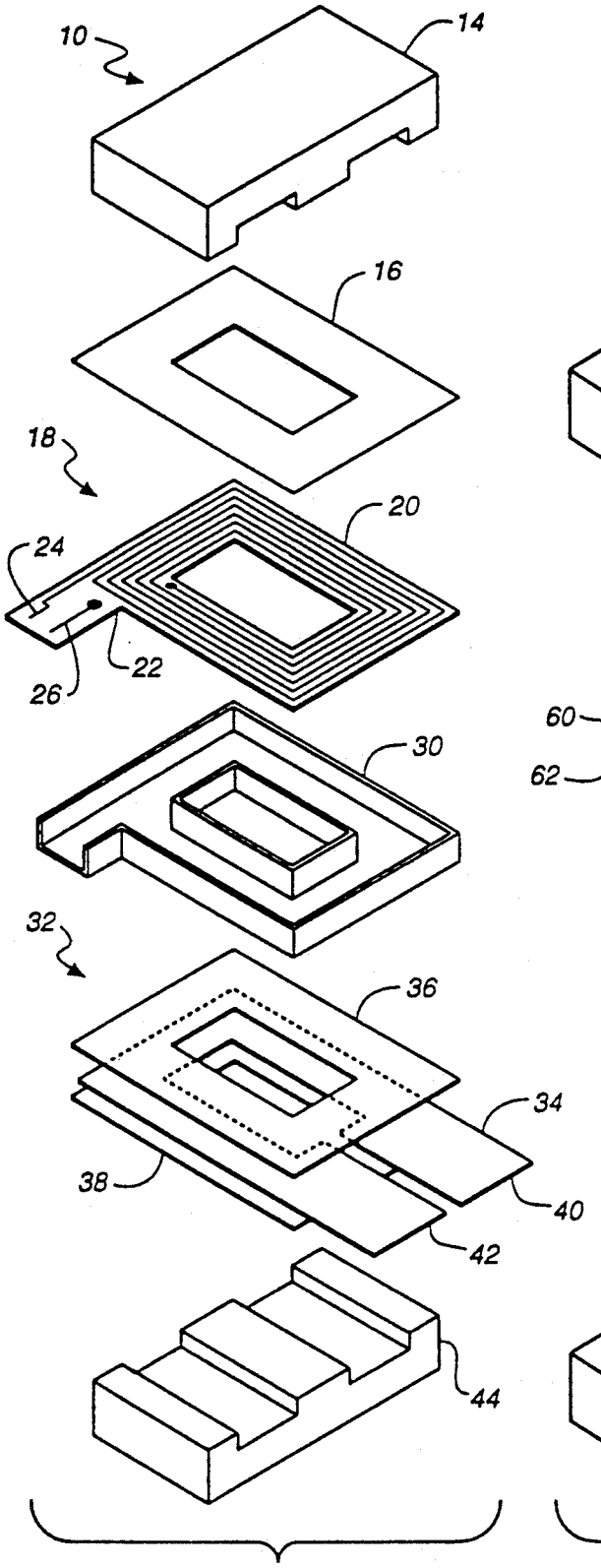
FIG. 1 (PRIOR ART)
FIG. 1 shows an exploded view of a prior art power transformer.

Various low profile power transformers have been available for use in power converters. An example of a prior art transformer is disclosed by Estrov in PCIM, August 1986, pp. 14 et. seq. FIG. 1 is an exploded view of a transformer 10 constructed according to the design taught by Estrov. Power transformer 10 comprises a top ferrite core 14 disposed on top of an insulator 16 which insulates ferrite core 14 from a primary winding assembly 18 comprising a copper spiral pattern 20 etched on a printed circuit board 22. Copper spiral pattern 20 includes leads 24, 26 for coupling the primary winding to other circuit elements (not shown). Both insulator 16 and printed circuit board 22 are disposed inside a plastic molding 30. Plastic molding 30 is placed on top of a secondary winding assembly 32 comprising a secondary winding 34 and two insulators 36, 38. Secondary winding 34 comprises a stamped copper foil having two leads 40, 42 for coupling to other circuit elements (not shown). A bottom ferrite core 44 matches with top ferrite core 14 so that primary winding assembly 18 and secondary winding assembly 32 are sandwiched between the two ferrite cores 14 and 44.

One of the problems with this prior art power transformer is that only a small amount of physical volume is used by the primary winding. As an example, primary winding assembly 18 typically consists of approximately 20% copper pattern and 80% printed circuit board material. As a result, power transformer 10 is very inefficient in utilizing the physical volume.

Another problem with power transformer 10 is that secondary winding 34 is not efficient in receiving magnetic flux generated by copper spiral pattern 20. This is because secondary winding 32 is located at one side of copper spiral pattern 20. Thus, some of the magnetic flux generated by pattern 20 does not reach secondary winding 34. Consequently, the electromagnetic coupling between primary winding 18 and secondary winding 32 is less than desired.

Figure 2:
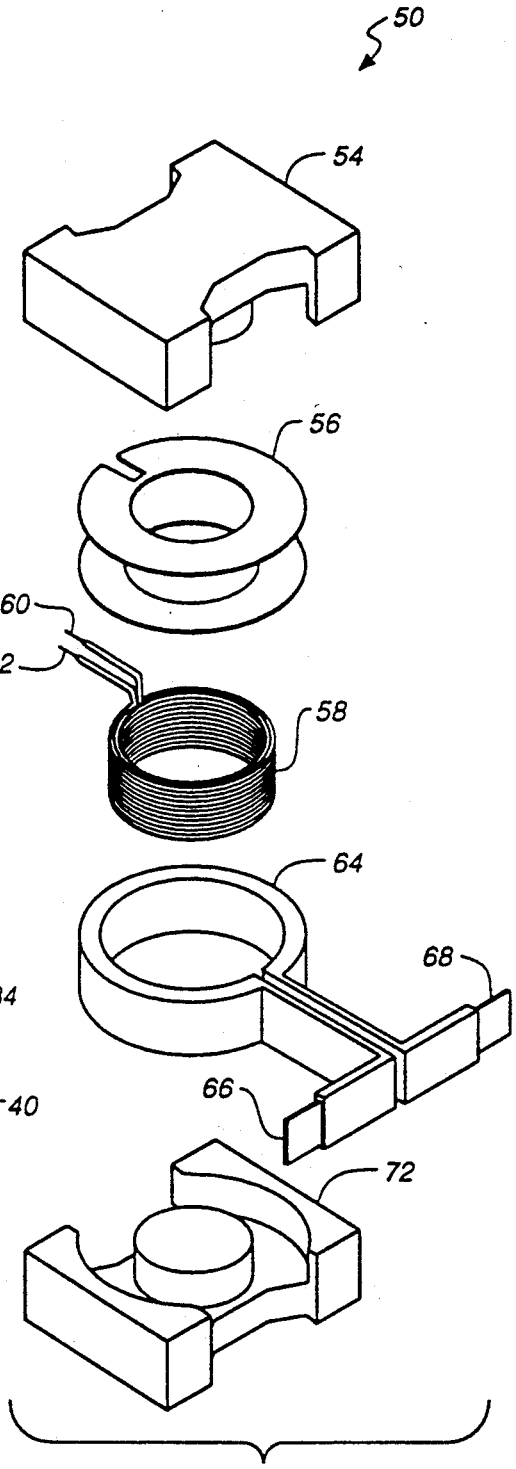
FIG. 2 (PRIOR ART)
FIG. 2 shows an exploded view of another prior art power transformer.

FIG. 2 is an exploded view of another prior art power transformer 50. Power transformer 50 comprises a top ferrite core 54 disposed on top of a bobbin 56. A primary winding 58 having two leads 60, 62 is wound around bobbin 56. The windings used in primary winding 58 are typically wire sleeved or coated with an insulator such as teflon. A secondary winding 64 comprising copper foil wrapped with tape surrounds primary winding 58. Secondary winding 64 also comprises two leads 66 and 68 for coupling to external circuit elements (not shown). A bottom ferrite core 72 matches with top ferrite core 54 so that bobbin 56, primary winding 58, and secondary winding 64 are sandwiched between the two ferrite cores 54, 72.

In power transformer 50, bobbin 56 provides the mechanical location of primary winding 58 and leads 60, 62. Bobbin 56 also provides insulation between primary winding 58 and the two ferrite cores 54, 72. In addition, the tape used for insulating secondary winding 64 and the sleeve used for insulating primary winding 58 also provide insulation.

One of the problems with power transformer 50 is that bobbin 56, the sleeve and the tape for insulating primary winding 58 and secondary winding 64 occupy a lot of physical volume. As a result, the physical dimension of power transformer 50 is larger than desired.

Another problem with power transformer 50 is that the electromagnetic coupling between primary winding 58 and secondary winding 64 could decrease as the height of power transformer 50 decreases. This is because the surface area of secondary winding 64 for receiving the magnetic flux generated by primary winding 58 decreases with decreasing height.

The transformer according to the present invention has enhanced electromagnetic coupling between the primary and secondary windings, reduced conduction loss, increased thermal dissipation, a low profile and a low overall volume. As is explained below, the isolation is improved by totally enclosing the primary winding in an insulating material. The electromagnetic coupling is enhanced by wrapping the secondary winding around both the top and bottom outer surfaces of the insulated primary winding. The conduction loss is reduced and thermal dissipation increased by increasing the surface area of the secondary winding. The low profile and low overall volume is due to the shape of the windings and the choice of core shape.

Figure 3A:
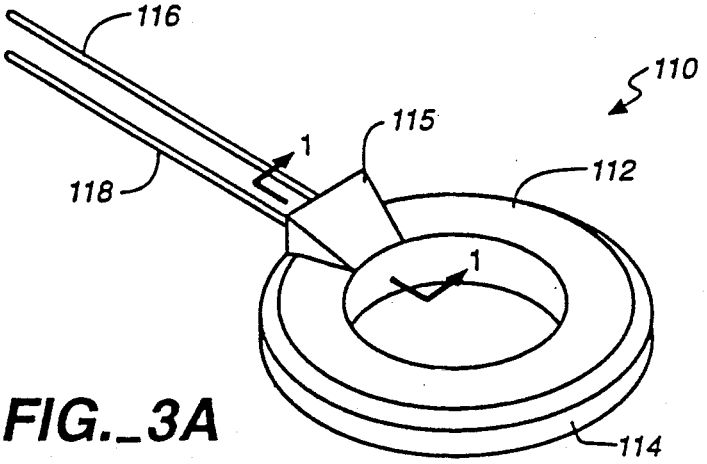
FIG. 3A shows a perspective view of an exemplary primary winding according to the present invention before it is enclosed by insulating material.

FIG. 3A is a drawing showing a perspective view of an exemplary primary winding 110 according to the present invention before the primary winding is encapsulated in an insulating material. Primary winding 110 comprises a bobbin 112, preferably made from plastic, wound with winding wire 114. Bobbin 112 preferably comprises a slanted section 115 for facilitating the winding of wire 114 inside bobbin 112, as explained below. Wire 114 further comprises leads 116, 118 for coupling to external circuit elements (not shown). Wire 114 is preferably magnet wire coated with enamel.

Figure 3B:
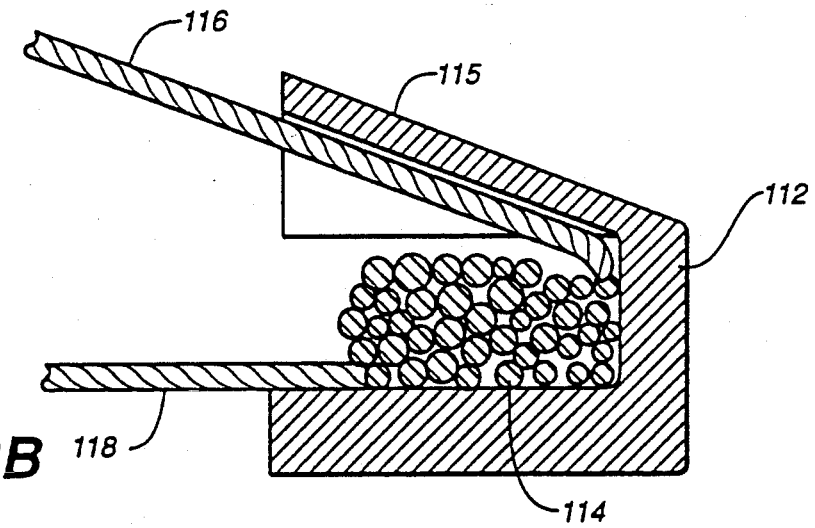
FIG. 3B shows a cross sectional view of an exemplary primary winding according to the present invention taken along the line 1—1 of FIG. 3A.

FIG. 3B is a drawing showing a cross sectional view across line 1—1 at slanted section 115 of bobbin 112. The parts in FIG. 3B which are the same as the corresponding parts in FIG. 3A are assigned the same numeral reference. Slanted section 115 gives more room for lead 116 to pass down to the inside of bobbin 112 before starting the first turn of the primary windings. In addition, the windings do not push against lead 116 because there is more room between lead 116 and the windings. Consequently, the chance of damaging the enamel insulation of lead 116 and the windings is reduced.

Figure 3C:
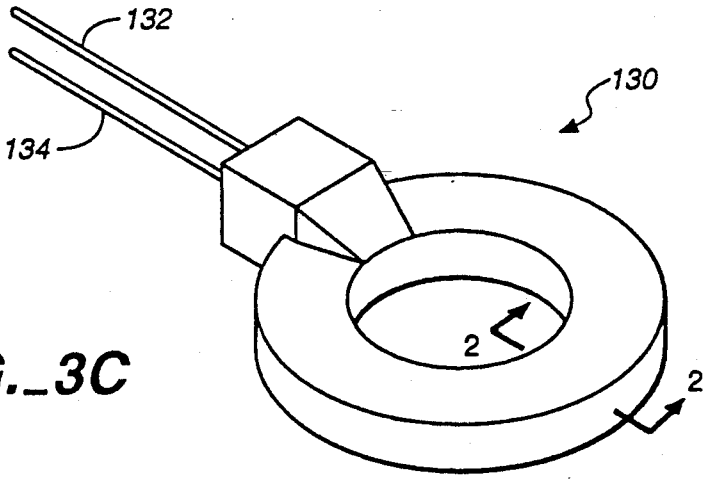
FIG. 3C shows a perspective view of an exemplary primary winding according to the present invention after it is enclosed by insulating material.

FIG. 3C is a drawing showing a perspective view of an exemplary primary winding 130 according to the present invention after the primary winding is encapsulated in an insulating material. As can be seen from FIG. 3C, the winding wire, shown as numeral reference 114 in FIG. 3A, is enclosed in the insulation material, preferably plastic, and is not visible in FIG. 3C. Only leads 132, 134, which correspond to leads 116, 118 in FIG. 3A, is exposed for coupling to external circuit elements (not shown).

Figure 3D:
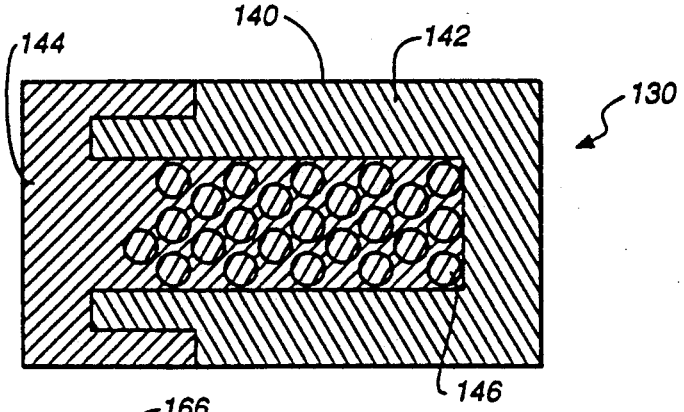
FIG. 3D shows a cross sectional view of an exemplary primary winding according to the present invention taken along the line 2—2 of FIG. 3C.

FIG. 3D is a drawing showing a cross sectional view across line 2—2 of primary winding 130, shown in FIG. 3C. Primary winding 130 includes an insulating enclosure 140. Insulating enclosure 140 further comprises two portions, a portion 142 corresponding to bobbin 112, shown in FIG. 3A, and a portion 144 which results from overmolding, as explained below. Primary winding 130 also comprises winding wire 146 which corresponds to winding wire 114, shown in FIG. 3A.

Encapsulating winding wire 146 in insulating material has the advantage that there is no creepage path between winding wire 146 and the other parts of the power transformer. As a result, the isolation between primary winding 130 and the other parts of the power transformer satisfies the safety requirements of UL 1950 and IEC 950.

In primary winding 130, winding wire 146 preferably occupies approximately 50% of the area, while the winding wire in prior art primary winding occupies less area, as described above. Thus, primary winding 130 is better able to utilize the physical volume.

The plastic chosen for bobbin 112, shown in FIG. 3A, preferably is a thermal plastic which is able to melt and reflow with overmolding plastic 144, shown in FIG. 3D, to form a homogeneous single part. Referring again to FIG. 3A, bobbin 112 preferably also locates the winding wire within a mold tool to guarantee a minimum thickness of insulation around the winding. An example of thermal plastic which could be used in the present invention is Rynite FR530.

The overmolding operation is now described. Bobbin 112 is placed inside a mold tool. The overmolding plastic which forms portion 144 is injected into the mold tool. The injection pressure forces the overmolding plastic down to the bottom of bobbin 112 into winding wire 114. The injection temperature and mold tool temperature must be chosen and controlled to allow plastic reflow, but not cause damage to the enamel coating of wire 114. In order to withstand the heat, winding wire 114 preferably comprises high temperature magnetic wire. The preferred injection pressure and temperature are 50 bar and 286° C., respectively. The preferred mold tool temperature is 60° C.

It is possible to use material other than plastic for overmolding. As an example, epoxy resin may be used. Epoxy resin may be casted into a desired shape by using a flexible mold which is made from silicone rubber. The shape of the silicone rubber mold is designed so that winding wire 114 is completely enclosed by epoxy resin. When the epoxy hardens, the flexible silicone mold could be peeled off the surface of the epoxy because epoxy does not stick to the surface of the silicone rubber.

It is also possible to completely enclose winding wire 114 without using a bobbin. This can be accomplished by using a spring winding so that wire 114 is self-supporting. Alternatively, the adjacent turns of the winding wire could be glued together as the winding is built on a mandrel. In addition, location jigs could be used to define the wire position within the mold tool.

Figure 4A:
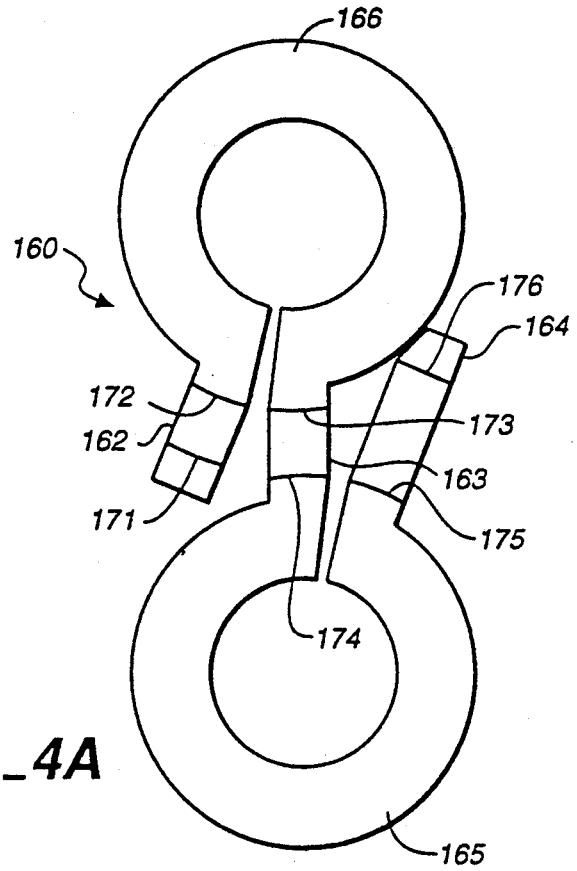
FIG. 4A shows a pattern on a conductive material which is used to form a secondary winding according to the present invention.

FIG. 4A is a drawing showing the shape of a pattern 160 stamped on a single sheet of copper foil and used as a secondary winding according to the present invention. Pattern 160 comprises three connecting sections 162–164 and two annulus windings 165, 166. These sections 162–166 are linked to each other in a continuous chain. Connecting sections 162–164 preferably bend at lines 171–176 for forming a secondary winding. The thickness of the copper foil is preferably 0.2 mm and the width of pattern 160 is preferably 3.5 mm.

Figure 4B:
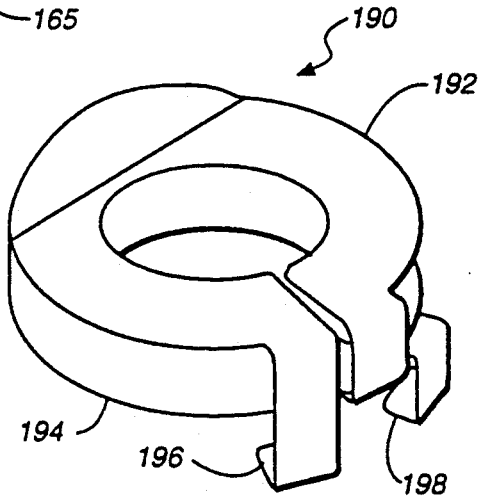
FIG. 4B shows a perspective view of an exemplary secondary winding according to the present invention formed from the pattern of FIG. 4A.

FIG. 4B is a drawing showing a perspective view of a secondary winding 190 formed from pattern 160, shown in FIG. 4A. Secondary winding 190 is formed from pattern 160 by bending pattern 160 at the scorings 171–176 such that the two planar annulus windings 192, 194, corresponding to sections 166, 167, respectively, of FIG. 4A, are parallel to each other and face each other. Leads 196, 198 are for coupling secondary winding 190 to external circuit elements (not shown).

Since secondary winding 190 has two annulus windings, the surface area of secondary winding 190 is larger than that of prior art secondary winding for an equivalent amount of volume occupied by the secondary windings. As is explained below, the increased surface area improves the performance of a power transformer using secondary winding 190.

Figure 5:
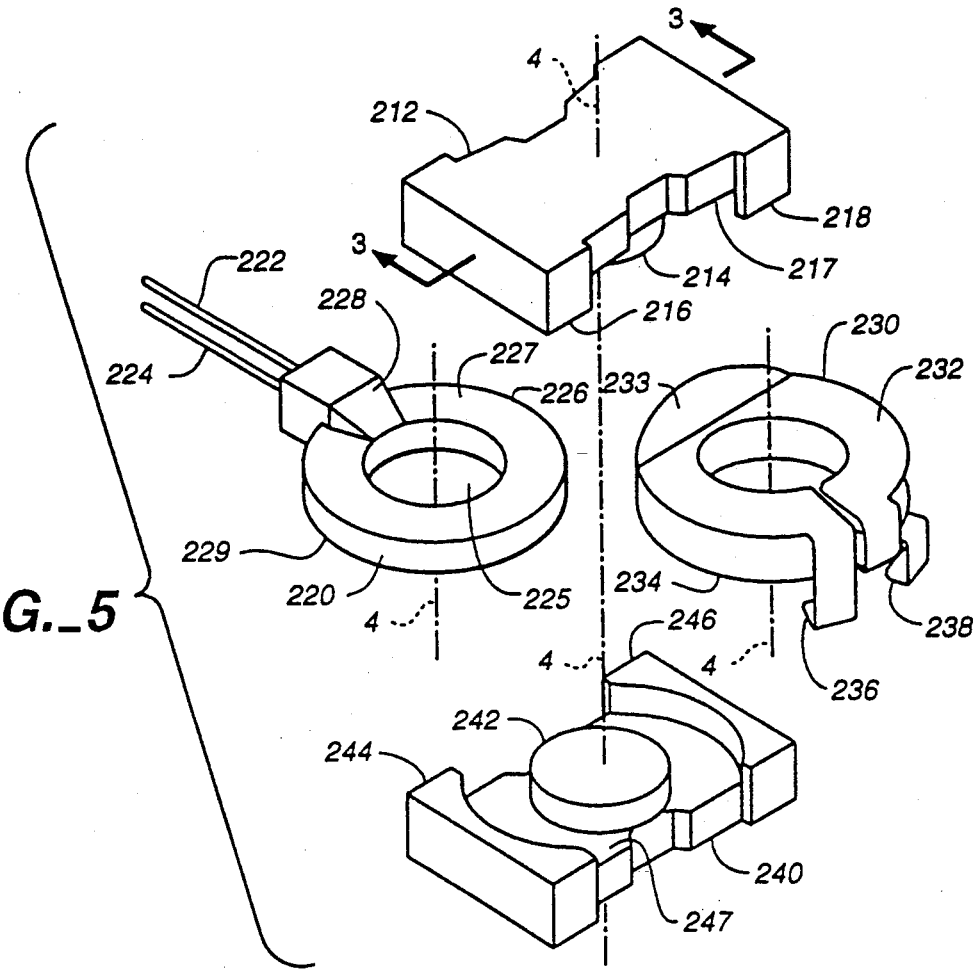
FIG. 5 shows an exploded view of a power transformer according to the present invention.

FIG. 5 is an exploded view of a power transformer 210 according to the present invention. Power transformer 210 comprises a top ferrite core 212 having a center pole 214 and outer poles 216, 218, an insulated primary winding 220, a secondary winding 230 having two annulus windings 232, 234, and a bottom ferrite core 240 having a center pole 242 and outer poles 244, 246. Insulated primary winding 220 is disposed inside the two annulus windings 232, 234 of secondary winding 230. The annulus windings 232, 234 of secondary winding 230 comprises a two turn winding. Ferrite cores 212 and 240 couple magnetic flux generated by primary winding 220 to secondary winding 230.

Although the exploded view in FIG. 5 shows that primary winding 220 is separated from secondary winding 230, primary winding 220, when transformer 210 is assembled, is actually inserted between the two annulus windings 232, 234 of secondary winding 230. The surface of two annulus windings 232, 234 are coextensive with the two planar surfaces 227, 229 of annulus section 226 of primary winding 220 and preferably touch the planar surfaces 227, 229 for enhancing electromagnetic coupling, as explained below. If primary winding 220 has a slanted section 228, annulus winding 232 should have a portion 233 having substantially the same angle as section 228 so that primary winding 220 can fit into secondary winding 230.

The components shown in FIG. 5, i.e., top ferrite core 212, primary winding 220, secondary winding 230 and bottom ferrite core 240, are coaxially assembled such that their vertical axes, shown as numeral reference 4 in FIG. 5, coincide. Top ferrite core 212 has a shaped recess 217 and bottom ferrite core 240 has a shaped recess 247 for accepting primary winding 220 and secondary winding 230. Primary winding 220 has a hole 225 for accepting center pole 214 of top ferrite core 212 and center pole 242 of bottom ferrite core 240. The diameter of the center openings of annulus windings 232, 234 are large enough so that center poles 214, 242 can pass through.

Figure 6:
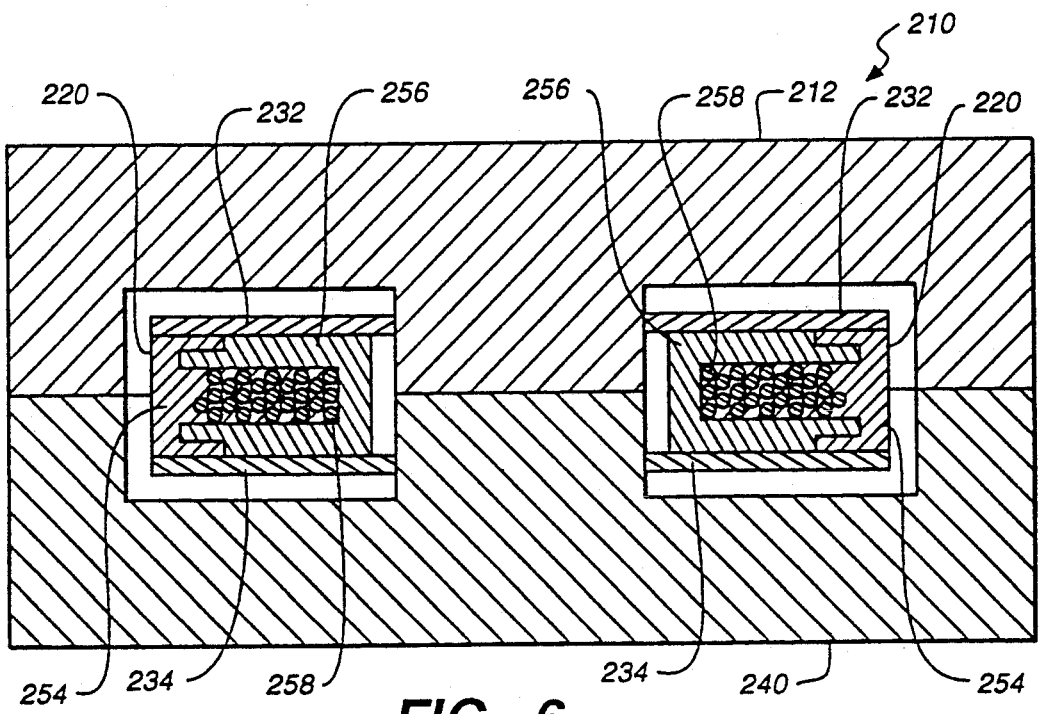
FIG. 6 shows a cross sectional view of the power transformer shown in FIG. 5 taken along the line 3—3.

FIG. 6 shows a cross sectional view of the assembled power transformer 210 shown in FIG. 5 taken along the line 3—3. The parts in FIG. 6 which are the same as the corresponding parts in FIG. 5 are assigned the same numeral reference. FIG. 6 shows primary winding 220 being placed between annulus windings 232 and 234, and the windings are surrounded by cores 212 and 240. FIG. 6 further shows winding wire 258 being enclosed by bobbin 256 and overmolding portion 254.

It is not necessary to insulate secondary winding 230 from ferrite cores 212, 240 because ferrite cores 212, 240 have high resistivity, a typical property of high frequency power ferrite cores. However, it is possible to enhance the insulation characteristic of power transformer 210 by adding extra insulation to secondary winding 230. Examples of suitable insulation materials are insulation tape and mylar discs.

Ferrite cores 212, 240 are preferably PQ cores or RM cores, available commercially, with their center poles 214, 242 and outer poles 216, 218, 244, 246 ground down to achieve a low profile. The shape of these cores permits the leads 236, 238 of secondary winding 230 to be formed into surface mount terminations below bottom ferrite core 240. As a result, power transformer 210 is compatible with surface mount technology.

The center pole diameter of center poles 214, 242 should be as small as possible, subject to core loss and core saturation limitations. A small diameter minimizes the winding length per turn and reduces conduction loss and the winding volume.

The dimensions of an exemplary power transformer constructed using the design described above are length 1.58 in., width 1.0 in., and height 0.63 in. The height of this exemplary power transformer is about 15% shorter than that of prior art power transformers having similar properties.

All the metal wire in primary winding 220 is totally enclosed by an insulating enclosure, except for two leads 222, 224 which are positioned outside transformer 210 and are used for coupled primary winding 220 to external circuit elements (not shown). As is explained above, leads 236, 238 of secondary winding 230 are positioned below bottom ferrite core 240. Thus, there is no creepage path between primary winding 220 and secondary winding 230 inside power transformer 210. In addition, the insulation enclosure used for primary winding 220 is able to withstand a Hi-Pot test of 3000 VAC. Consequently, the isolation requirements of UL 1950 and IEC 950 are easily met.

The electromagnetic coupling between primary winding and secondary winding is better than prior art power transformers, because most of the surface area of insulated primary winding 220 is covered by the two annulus windings 232, 234. As a result, a large amount of magnetic flux generated by primary winding 220 is able to reach secondary winding 230. In addition, the electromagnetic coupling does not reduce with decreasing height, as is the case in some prior art power transformer.

As was noted above, secondary winding 230 has a large surface area compared with prior art secondary windings. One of the advantages of this large surface area is that a large amount of current can be carried by secondary winding 230. In high frequency operation, the amount of current carried by a conductor is proportional to its surface area. This is because the skin depth is small so that practically all the current flows along the surface. As an example, the skin depth for 1 MHz operation is about 0.066 mm, i.e., most of the current is concentrated within 0.066 mm from the surface, regardless of how thick the conductor is. Thus, a larger surface area carries more current. In addition, the proximity effect, i.e., the re-distribution of current in a conductor due to the presence of other current carrying conductors, which could limit the amount of current in a conductor, is also reduced by using a larger surface area. Thus, a power transformer constructed according to the present invention can carry a larger amount of current than prior art power transformers.

Another advantage of a large surface area is that heat dissipation is proportional to the surface area. As was noted above, heat dissipation is one of the major problems for power transformer as the size of the power transformer is reduced. Thus, a power transformer constructed according to the present invention has a better ability to dissipate heat than prior art power transformers.

The invention is described in terms of the preferred embodiments. It will be realized that other modifications and variations will be apparent from the above description to those skilled in the art. These modifications and variations are intended to be within the scope of the present invention and the invention is not intended to be limited except by the following appended claims.

What is claimed is:

1. A power transformer comprising:

a primary winding including a length of winding wire forming at least one loop about a central axis and having first and second leads for coupling said primary winding to an external circuit, said primary winding generating magnetic flux in response to a current flowing through said wire;

an insulating enclosure for encapsulating the entire surface of said primary winding other than said first and said second leads, said insulating enclosure being substantially filled with an insulating material, said insulating enclosure having a first planar surface positioned substantially perpendicular to said central axis, a second planar surface on the opposite side of said primary winding from said first planar surface, and a side surface connecting the perimeters of said first and said second planar surfaces such that said primary winding is enclosed therein;

a secondary winding having a first and a second planar winding, each of said first and said second windings being stamped from a conductive foil sheet, said first and said second planar winding being electrically connected, said insulating enclosure being positioned between said first and said second planar windings such that said first planar surface faces said first planar winding and said second planar surface faces said second planar winding; and means for coupling said magnetic flux from said primary winding to said secondary winding thereby allowing energy to transfer from said primary winding to said secondary winding.

2. The power transformer of claim 1 wherein said means for coupling comprises a core.

3. The power transformer of claim 1 wherein said insulating enclosure comprises a bobbin portion for positioning said winding wire of said primary winding and an overmolding portion for enclosing said winding wire within said overmolding portion and said bobbin portion.

4. A power transformer comprising:

a primary winding including a length of winding wire forming at least one circular loop about a central axis and having first and second leads for coupling said primary winding to an external circuit, said primary winding generating magnetic flux in response to a current flowing through said wire:

an insulating enclosure for encapsulating the entire surface of said primary winding other than said first and said second leads, said insulating enclosure being substantially filled with an insulating material, said insulating enclosure having a first planar surface positioned substantially perpendicular to said central axis, a second planar surface on the opposite side of said primary winding from said first planar surface, and a side surface connecting the perimeters of said first and said second planar surfaces such that said primary winding is enclosed therein;

a secondary winding having a first and a second conductive annulus winding, each of said first and said second annulus windings being stamped a conductive foil sheet, said first and said second planar windings being electrically connected said insulating enclosure being positioned between said first and said second planar windings such that said first planar surfaces faces said first planar winding and said second planar surface faces said second planar winding; and a core having a portion positioned coaxially with said primary and said secondary windings, said core coupling said magnetic flux from said primary winding to said secondary winding.

5. The power transformer of claim 4 wherein said first annulus winding and said second annulus winding are stamped as a single piece from a conductive foil sheet.

6. The power transformer of claim 4 wherein said insulating enclosure comprises a bobbin portion for positioning said winding wire of said primary winding and an overmolding portion for enclosing said winding wire within said bobbin portion and said overmolding portion.

7. The power transformer of claim 4 wherein said core comprises a first and a second ferrite portion, said first and said said portions substantially surrounding said primary and said secondary windings.

8. A power transformer comprising:

a primary winding including a length of winding wire forming at least one circular loop about a central axis and having first and second leads for coupling said primary winding to an external circuit, said primary winding generating magnetic flux in response to a current flowing through said wire;

an insulating enclosure for encapsulating the entire surface of said primary winding other than said first and said second leads, said insulating enclosure being substantially filled with an insulating material, said insulating enclosure having a first planar surface positioned substantially perpendicular to said central axis, a second planar surface on the opposite side of said primary winding from said first planar surface, and a side surface connecting the perimeters of said first and said second planar surfaces such that said primary winding is enclosed therein;

a secondary winding having a first and a second conductive annulus winding, each of said first and said second annulus windings being stamped from a conductive foil sheet, said first and said second planar windings being electrically connected said insulating enclosure being positioned between said first and said second planar windings such that said first planar surface faces said first planar winding and said second planar surface faces said second planar winding;

a first core having a first, a second, a third and a fourth portion, said first portion of said first core being positioned coaxially with said primary winding and said secondary winding, said second portion of said first core being in a substantially parallel relationship to said secondary winding, said third and said fourth portions of said first core being in a substantially perpendicular relationship to said secondary winding; and a second core having a first, a second, a third and a fourth portion, said first portion of said second core being substantially coaxial with said first portion of said second core, said second portion of said second core being in a substantially parallel relationship to said second portion of said first core, said third portion of said second core being positioned on top of said third portion of said first core, said fourth portion of said second core being positioned on top of said fourth portion of said first core, said primary and said secondary windings being disposed between said first core and said second core such that said second, third, and fourth portions of said first core and said second core substantially surround said primary and said secondary windings.

9. A power transformer of claim 8 wherein said first annulus winding, said second annulus winding, and said connecting section are stamped as a single piece from a conductive foil sheet.

10. A power transformer of claim 8 wherein said first core has a shaped recess for housing said primary winding and said secondary winding.

11. A power transformer of claim 8 wherein said second core has a shaped recess for housing said primary winding and said secondary winding.

12. The power transformer of claim 1 wherein said insulating enclosure further comprises a central aperture substantially parallel to said side surface and wherein said first and said second planar windings further comprise a respective central aperture.

13. The power transformer of claim 1 wherein said secondary winding is stamped as a single piece from a conductive foil sheet.

* * * * *